US007030831B2

(12) United States Patent
Nilsson

(10) Patent No.: US 7,030,831 B2
(45) Date of Patent: Apr. 18, 2006

(54) MULTI-POLARIZED FEEDS FOR DISH ANTENNAS

(75) Inventor: Jack Nilsson, Medina, OH (US)

(73) Assignee: WiFi-Plus, Inc., Brunswick Hills, OH (US)

( * ) Notice: Subject to any disclaimer, the term of this patent is extended or adjusted under 35 U.S.C. 154(b) by 2 days.

(21) Appl. No.: 10/786,656

(22) Filed: Feb. 25, 2004

(65) Prior Publication Data

US 2004/0164920 A1 Aug. 26, 2004

Related U.S. Application Data

(63) Continuation-in-part of application No. 10/294,420, filed on Nov. 14, 2002, now Pat. No. 6,806,841.

(51) Int. Cl.
*H01Q 19/12* (2006.01)

(52) U.S. Cl. ..... 343/840; 343/789

(58) Field of Classification Search ..... 343/775, 343/779, 789, 790, 781 R, 840
See application file for complete search history.

(56) References Cited

U.S. PATENT DOCUMENTS

| | | | | |
|---|---|---|---|---|
| 2,218,707 | A | 10/1940 | Franz | |
| 2,828,486 | A * | 3/1958 | Scheldorf | 343/781 R |
| 3,383,694 | A | 5/1968 | Stohmeyer, Jr. | |
| 3,845,483 | A * | 10/1974 | Soma et al. | 343/761 |
| 4,253,099 | A | 2/1981 | Yamazaki et al. | |
| 4,958,167 | A | 9/1990 | Schroeder | |
| 5,406,295 | A | 4/1995 | Baranski et al. | |
| 5,506,592 | A * | 4/1996 | MacDonald et al. | 343/846 |
| 5,805,113 | A | 9/1998 | Ogino et al. | |
| 5,880,699 | A * | 3/1999 | McCorkle | 343/840 |
| 6,522,305 | B1 * | 2/2003 | Sharman | 343/781 CA |
| 6,697,028 | B1 * | 2/2004 | Gothard et al. | 343/781 CA |

OTHER PUBLICATIONS http://www.magneticsciences.com/UWBandVpolAnts~ns4.html, "Ultra-Wideband (UWB) and Multiband antenna for RF, microwaves and UWB.".
http://www.magneticsciences.com/MultibeamSATCOMantenna~ns4.html, "Multiple Beam Antenna for Satellite Communications and LOS Communications,".
http://www.northcountryradio.com/Articles/discfig2.htm, "Discone Figures,".
http://kylet1.aswwc.net/index.php?page=projects&old_project+80211B_discone, "Tim and David's 2.4 GHz802.11b Discone,".
http://www.wave-report.com/tutorials/OFDM.htm, "OFDM Tutorial,".

* cited by examiner

*Primary Examiner*—Shih-Chao Chen
*Assistant Examiner*—Marie Antoinette Cabucos
(74) *Attorney, Agent, or Firm*—Hahn, Loeser & Parks, LLP

(57) ABSTRACT

A multi-polarized forward feed and dish configuration for transmitting and/or receiving radio frequency (RF) signals is disclosed. The configuration comprises a conductive reflector dish, having a focal point and a vertex point, and a multi-polarized forward feed element positioned substantially at the focal point. The forward feed element comprises at least two radiative members each having a first end and a second end. The second ends of the radiative members are electrically connected at an apex point and are each disposed outwardly away from the apex point toward the vertex point at an acute angle relative to an imaginary plane intersecting the apex point.

22 Claims, 10 Drawing Sheets

4-element beam antenna
with a multi-polarized tri-element driver

MULTI-POLARIZED FEEDS FOR DISH ANTENNAS

CROSS-REFERENCE TO RELATED APPLICATIONS/INCORPORATION BY REFERENCE

This application is a continuation-in-part (C-I-P) of patent application Ser. No. 10/294,420 filed on Nov. 14, 2002, now U.S. Pat. No. 6,806,841 isued Oct. 19, 2004, which is incorporated herein by reference in its entirety.

U.S. application Ser. No. 10/787,031 entitled "Apparatus and Method for a Multi-Polarized Antenna" and filed on the same day as the application herein, is incorporated herein by reference in its entirety.

U.S. application Ser. No. 10/787,025 entitled "Apparatus and Method for a Multi-Polarized Ground Plane Beam Antenna" and filed on the same day as the application herein, is incorporated herein by reference in its entirety.

U.S. Pat. No. 6,496,152 issued on Dec. 17, 2002 is incorporated herein by reference in its entirety.

TECHNICAL FIELD

Certain embodiments of the present invention relate to feed elements for dish reflector antennas used in wireless communications. More particularly, certain embodiments of the present invention relate to providing a multi-polarized antenna feed element exhibiting substantial spatial diversity for use in communication applications for the Internet, cellular telephone, maritime, aviation, satellite, and space.

BACKGROUND OF THE INVENTION

For years, wireless communications including Wi-Fi, WWAN, and WLAN, Cell/PCS phones, Land Mobile radio, aircraft, satellite, etc. have struggled with limitations of audio/video/data transport and internet connectivity in both obstructed (indoor/outdoor) and line-of-site (LOS) deployments.

A focus on gain as well as circuitry solutions have proven to have significant limitations. Unresolved, non-optimized (leading edge) technologies have often given way to "bleeding edge" attempted resolutions. Unfortunately, all have fallen short of desirable goals, and some ventures/companies have even gone out of business as a result.

While lower frequency radio waves benefit from an 'earth hugging' propagation advantage, higher frequencies do inherently benefit from (multi-) reflection/penetrating characteristics. However, with topographical changes (hills & valleys) and object obstructions (e.g., natural such as trees, and man-made such as buildings/walls) and with the resultant reflections, diffractions, refractions and scattering, maximum signal received may well be off-axis (non-direct path) and multi-path (partial) cancellation of signals results in null/weaker spots. Also, some antennas may benefit from having gain at one elevation angle ('capturing' signals of some pathways), while other antennas have greater gain at another elevation angle, each type being insufficient where the other does well. In addition, the radio wave can experience altered polarizations as they propagate, reflect, diffract, refract, and scatter. A very preferred (polarization) path may exist, however, insufficient capture of the signal can result if this preferred path is not utilized.

Spatial diversity can distinctly help with some of the null-spot issues. Some radio equipment comes equipped with two switched antenna connections to reduce null spot problems experienced by a single antenna due to multi-path signals. A single antenna may receive signals out of phase from different paths, causing the resultant received signal to be nulled out (i.e., the individual signals received from the different paths cancel each other out). With two antennas, if one antenna is experiencing null cancellation, the other, if positioned properly with respect to the first antenna, will not. VOFDM (Vector Orthogonal Frequency Division Multiplexing) technology helps with some multi-path out-of-phase 'data clash' issues. Electronically steer-able antenna arrays alleviate some interference problems and provide a solution where multiple standard directional antenna/radio systems would otherwise be more difficult or clearly impractical. Dual slant polarization antenna/circuitry switching systems have shown much advantage over others in (some) obstructed environments but require additional complex circuitry. Circularly polarized systems can also provide some penetration advantages.

Certainly, gain (increased ability to transmit and receive signals in a particular direction) is important. However, if polarization of the signal and antenna are not matched, poor performance may likely result. For example, if the transmitting antenna is vertically polarized and the receiving antenna is also vertically polarized, then the transmitting and receiving antennas are matched for wireless communications. This is also true for horizontally polarized transmitting and receiving antennas.

However, if a first antenna is horizontally polarized (e.g., a TV house antenna) and a second antenna (e.g., TV transmitting antenna) is vertically polarized, then the signal received by the first antenna will be reduced, due to polarization mismatch, by about 20 dB (to about $1/100^{th}$ of the signal that could be received if polarizations were matched). For example, a vertically polarized antenna with 21 dBi of gain, attempting to receive a nearly horizontally polarized signal, is essentially a 1 dBi gain antenna with respect to the horizontally polarized signal and may not be effective.

As another example, a vertically or horizontally polarized antenna that is tilted at 45 degrees can receive both vertically and horizontally polarized signals, but at a power loss of 3 dB (½ power). However, if the signal to be received is also at a 45-degree tilt, but perpendicular to the 45-degree tilt of the receiving antenna, then the signal is again reduced to $1/100^{th}$ of the potential received signal. Having two antennas where one is vertically polarized and the other is horizontally polarized can help, but still has its disadvantages. Therefore, gain is important but, to be effective, polarization should be considered as well.

Traditional dish reflector antenna configurations typically incorporate a single feed element at the focal point of a parabolic dish reflector. The feed element is typically polarized in one linear dimension (e.g., vertical or horizontal) or is circularly or elliptically polarized.

Tower space for antennas is at a premium across the nations. An attempt to alleviate this problem, which has had difficulties, is to create dual-band point-to-point directional dish antennas with orthogonal feeds. However, this approach limits efficient multi-band capability to two bands and is typically only singularly or single-hand circularly polarized per band.

Further limitations and disadvantages of conventional, traditional, and proposed approaches will become apparent to one of skill in the art, through comparison of such systems with the present invention as set forth in the remainder of the present application with reference to the drawings.

BRIEF SUMMARY OF THE INVENTION

A first embodiment of the present invention provides a multi-polarized forward feed and dish configuration for transmitting and/or receiving radio frequency (RF) signals. The configuration comprises a conductive reflector dish, having a focal point and a vertex point, and a multi-polarized forward feed element positioned substantially at the focal point. The forward feed element comprises at least two radiative members each having a first end and a second end. The second ends of the radiative members are electrically connected at an apex point and are each disposed outwardly away from the apex point toward the vertex point at an acute angle relative to an imaginary plane intersecting the apex point.

A second embodiment of the present invention provides a multi-polarized forward feed for transmitting and/or receiving radio frequency (RF) signals to/from a reflector dish. The forward feed comprises at least two radiative members each having a first end and a second end. The second ends of the radiative members are electrically connected at an apex point and are each disposed outwardly away from the apex point at an acute angle relative to an imaginary plane intersecting the apex point. The forward feed further comprises a truncated pyramidal conductor that includes a closed truncated side, an open base side, and three closed trapezoidal sides. As defined herein, closed can mean a contiguous or partially contiguous surface. For example, a solid conductive sheet is contiguous and a mesh or crosshatched conductive sheet is partially contiguous. An open interior space of the truncated pyramidal conductor encompasses the radiative members such that the apex point is approximately at a center point of the closed truncated side and the radiative members are disposed outwardly away from the closed truncated side toward the open base side.

A third embodiment of the present invention provides a multi-polarized forward feed and dish configuration for transmitting and/or receiving radio frequency (RF) signals. The configuration comprises a first conductive reflector dish having a first focal point and a second conductive reflector dish having a second focal point and being substantially identical to the first conductive reflector dish. The configuration further comprises a first multi-polarized ground plane beam antenna positioned substantially at the first focal point to act as a transmit/receive feed for the first conductive reflector dish, and a second multi-polarized ground plane beam antenna, being substantially identical to the first multi-polarized ground plane beam antenna, positioned substantially at the second focal point to act as a transmit/receive feed for the second conductive reflector dish.

These and other advantages and novel features of the present invention, as well as details of an illustrated embodiment thereof, will be more fully understood from the following description and drawings.

DETAILED DESCRIPTION OF THE INVENTION

Figure 1A:
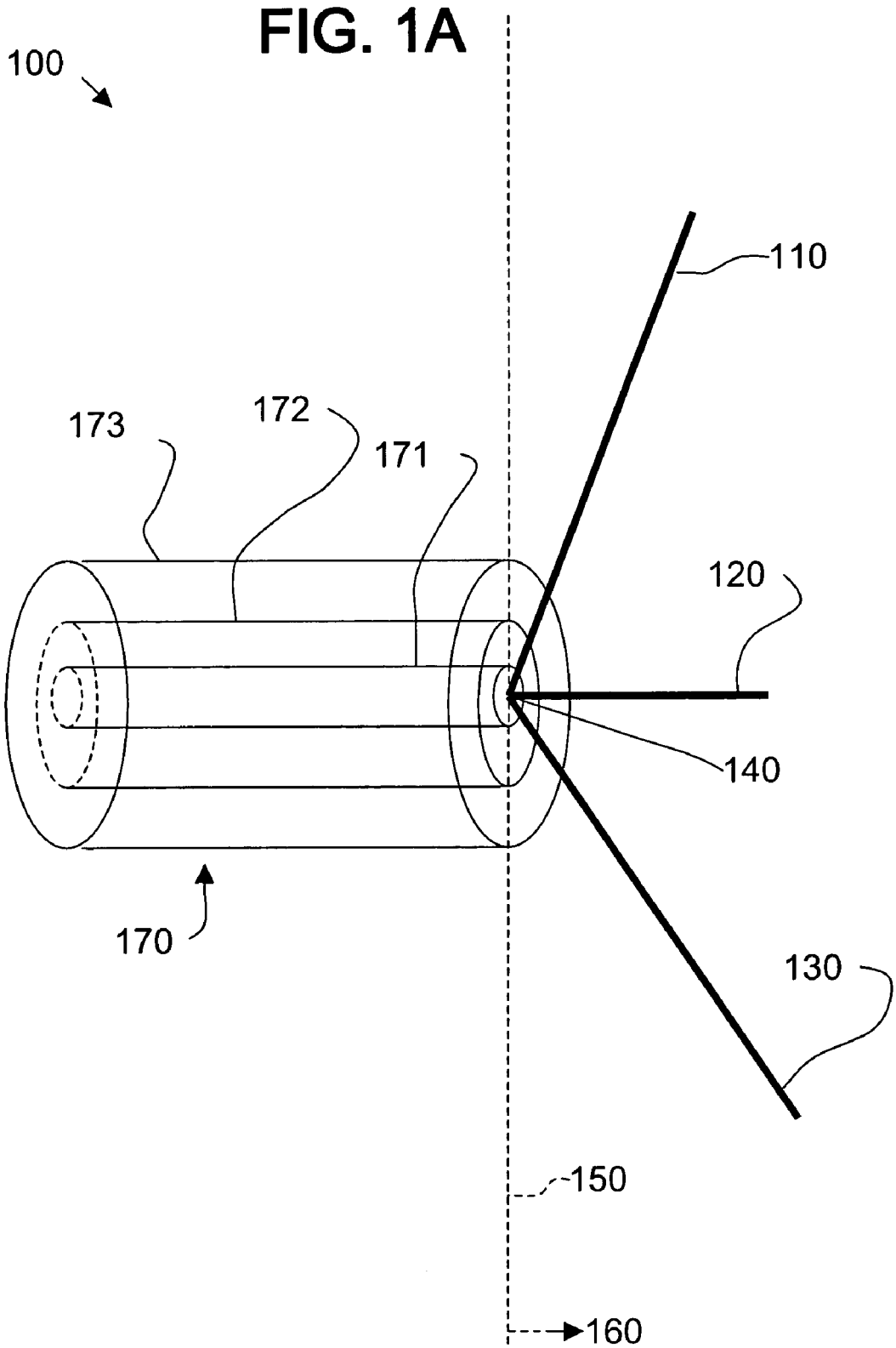
FIG. 1A illustrates a first embodiment of a multi-polarized forward feed element, in accordance with various aspects of the present invention.

FIG. 1A illustrates a first embodiment of a multi-polarized forward feed element 100, in accordance with various aspects of the present invention. The multi-polarized feed element 100 comprises a first radiative member 110, a second radiative member 120, and a third radiative member 130. The three radiative members 110, 120, and 130 of the feed element 100 are electrically connected together at an apex point 140 such that the three radiative members 110, 120, and 130 are each disposed outwardly away from the apex point 140 at an acute angle of between 1 degree and 89 degrees relative to an imaginary plane 150 intersecting the apex point 140. The radiative members 110, 120, and 130 are all located to a first side 160 of the imaginary plane 150.

When multiple radiative members (e.g., three) are positioned over a ground plane and properly spaced, many more polarizations may be generated and/or received in many more different directions than for a single radiative member. Therefore, such a feed element is said to be "multi-polarized" as well as providing "geometric spatial capture of signal". If a feed element produced all polarizations in all planes (i.e., all planes in an x, y, z coordinate system) and the receiving antenna is capable of capturing all polarizations in all planes, then the significantly greatest preferred polarization path (maximum amplitude signal path) may be availably utilized.

Electromagnetic waves are often reflected, diffracted, refracted, and scattered by surrounding objects, both natural and man-made. As a result, electromagnetic waves that are approaching a receiving antenna can be arriving from multiple angles and have multiple polarizations and signal levels. The feed element 100 of FIG. 1 is able to capture or utilize the preferred approaching signal whether the preferred signal is a line-of-site signal or a reflected signal, and no matter how the signal is polarized.

In accordance with an embodiment of the present invention, each radiative member 110, 120, and 130 is conductive and is substantially linear, coiled or not, and having two ends. The length of each radiative member 110, 120, and 130 is "cut" to be tuned to a predetermined radio frequency. Each radiative member 110, 120, and 130 may be cut to the same predetermined radio frequency or to differing radio frequencies, in accordance with various aspects of the present invention. For example, in accordance with an embodiment of the present invention, each radiative member 110, 120, and 130 is cut to a physical length that is approximately one-quarter wavelength of a desired radio frequency of transmission. Each radiative member 110, 120, and 130 may be at a unique acute angle or at the same acute angle relative to the imaginary plane 150. In accordance with an embodiment of the present invention, the three radiative members 110, 120, and 130 are spaced circumferentially at 120 degrees from each other. Other spacings are possible as well.

In accordance with an embodiment of the present invention, the multi-polarized feed element 100 includes an electrical connector (e.g., a coaxial connector) 170 which comprises a center conductor 171, an insulating dielectric region 172, and an outer conductor 173. The electrical connector 170 serves to mechanically connect the three radiative members 110, 120, and 130 to a ground reference and to allow electrical connection of the radiative members 110, 120, and 130 and the ground reference to a transmission line for interfacing to a radio frequency (RF) transmitter and/or receiver.

Figure 1B:
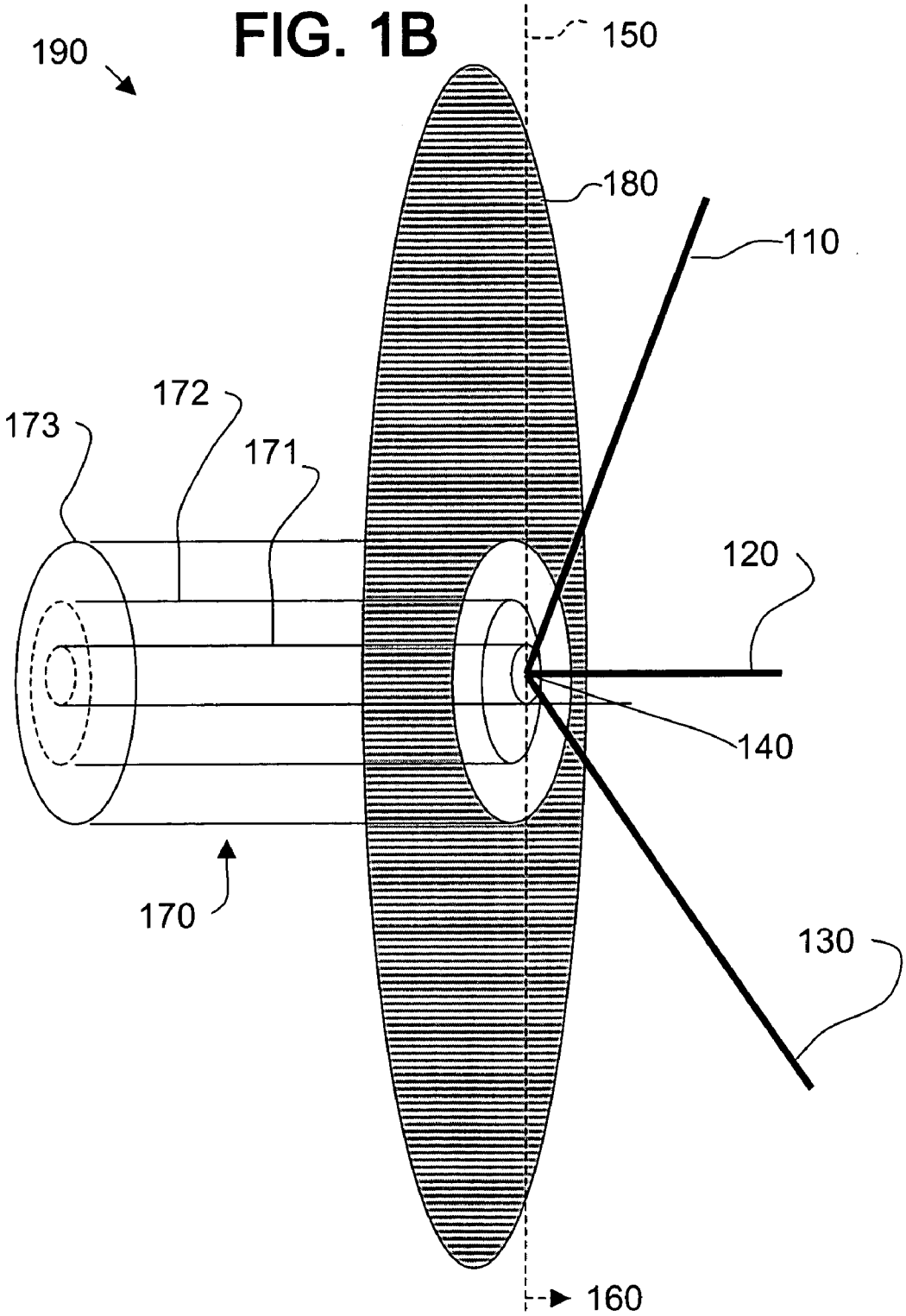
FIG. 1B illustrates a second embodiment of a multi-polarized forward feed element, in accordance with various aspects of the present invention.

FIG. 1B illustrates a second embodiment of a multi-polarized forward feed element 190, in accordance with various aspects of the present invention. The feed element 190 includes all of the elements of FIG. 1A and further includes a ground plane 180. In accordance with an embodiment of the present invention, the ground plane comprises a flat circular conductor having a radius of at least ¼ wavelength of a tuned radio frequency.

For example, the center conductor 171 may electrically connect to the apex 140 of the radiative members 110, 120, and 130 and the outer conductor 173 may electrically connect to the ground plane 180. The insulating dielectric region 172 electrically isolates the center conductor 140 (and therefore the radiative members 110, 120, and 130) from the outer conductor 173 (and therefore from the ground plane 180). The insulating dielectric region 172 may also serve to mechanically connect the radiative members 110, 120, and 130 to the ground plane 180, in accordance with an embodiment of the present invention.

In accordance with other embodiments of the present invention, the number of radiative members may be only two or may be greater than three. For example, four radiative members circumferentially spaced at 90 degrees, or otherwise, may be used. In fact, a large number of radiative members may be effectively replaced with a continuous surface of a cone, a pyramid, or some other continuous shape that is spatially diverse on one side (i.e., has significant spatial extent) and comes substantially to a point (e.g., an apex) on the other side. For example, in accordance with an embodiment of the present invention, a linear radiative member connected at one end to a radiative loop having a certain spatial extend may be used.

Figure 2:
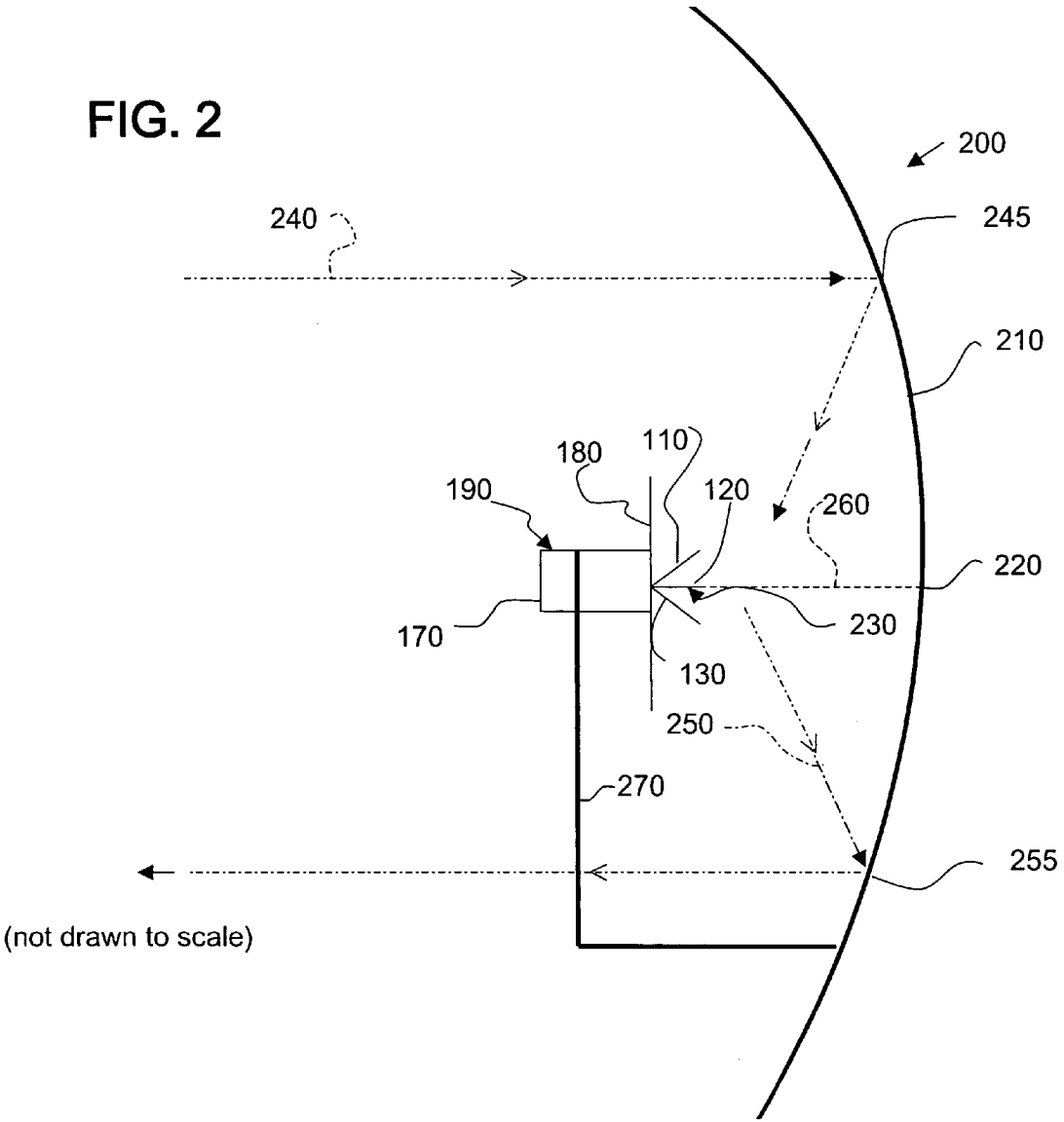
FIG. 2 illustrates a first embodiment of a multi-polarized forward feed and dish configuration using the feed element of FIG. 1A, in accordance with various aspects of the present invention.

FIG. 2 illustrates a first embodiment of a multi-polarized forward feed and dish configuration 200 using the feed element 190 of FIG. 1A, in accordance with various aspects of the present invention. The configuration 200 comprises a reflector dish 210 and a feed element 190. The reflector dish 210 may comprise, for example, a conductive parabolic reflector, a conductive partial parabolic reflector, or a skewed parabolic reflector (these dish reflector terms are known generally herein as paraboloids). The reflector dish 210 includes a vertex point 220 and focuses radio frequency energy of a predetermined frequency to a focal point 230 (the focal point is not a physical part of the dish). The radiative members 110, 120, and 130 of the feed element 190 are positioned substantially at the focal point 230.

A parabola is a two-dimensional curve generally defined by a mathematical equation (e.g., $y=ax^2+b$) or more specifically (e.g., $y=\frac{1}{4}(x^2/F)$, where F is the focal point). The parabolic curve has a vertex point (the bottom point of the curve) and a focal point, each disposed on the central axis with the focal point being above the vertex point. A paraboloid of revolution (i.e., a parabolic reflector) is a three-dimensional shape resulting from the curve being rotated 360 degrees about the central axis. Gain is a function of parabolic reflector diameter, surface accuracy, and radio frequency illumination of the reflector by a feed element.

Desirably, a collimated beam of radio frequency energy is produced when the parabolic reflector is illuminated by the feed element. A parabolic reflector operates over a wide range of frequencies, limited at the low end by its diameter and at the high end by its surface accuracy. All parabolic dishes have the same parabolic curvature, but some are shallow dishes, and others are much deeper and shaped more like a bowl.

By placing an isotropic radiative source (i.e., a feed element) at the focal point of a parabolic reflector, the radiated wave will be reflected from the parabolic surface as a plane wave. A parabolic reflector obtains maximum gain and maintains in phase reflective components at the radiative source. A parabolic reflector has the property that it directs parallel rays from different sources onto its focal point and, conversely, concentrates rays from a source at its focal point into an intense beam parallel to the central axis of the parabola.

Referring to FIG. 2, a radio frequency (RF) ray 240 coming from a far off source of RF radiation and impinging on the reflector dish 210 at the point 245 will reflect off of the reflector dish 210 toward the focal point 230. Similarly, an RF ray 250 coming from the feed element 190 and impinging on the reflector dish 210 at the point 255 will reflect off of the reflector dish 210 and out away from the reflector dish 210 along a direction that is parallel to the central axis 260 of the reflector dish 210.

In accordance with an embodiment of the present invention, the configuration 200 further includes a mounting mechanism 270 to allow mounting of the feed element 190 at the focal point 230. The mounting mechanism 270 may be attached to the feed element 190 and the reflector dish 210 or to the feed element 190 and some other structure that allows the feed element 190 to be positioned at the focal point 230 of the reflector dish 210.

Figure 3A:
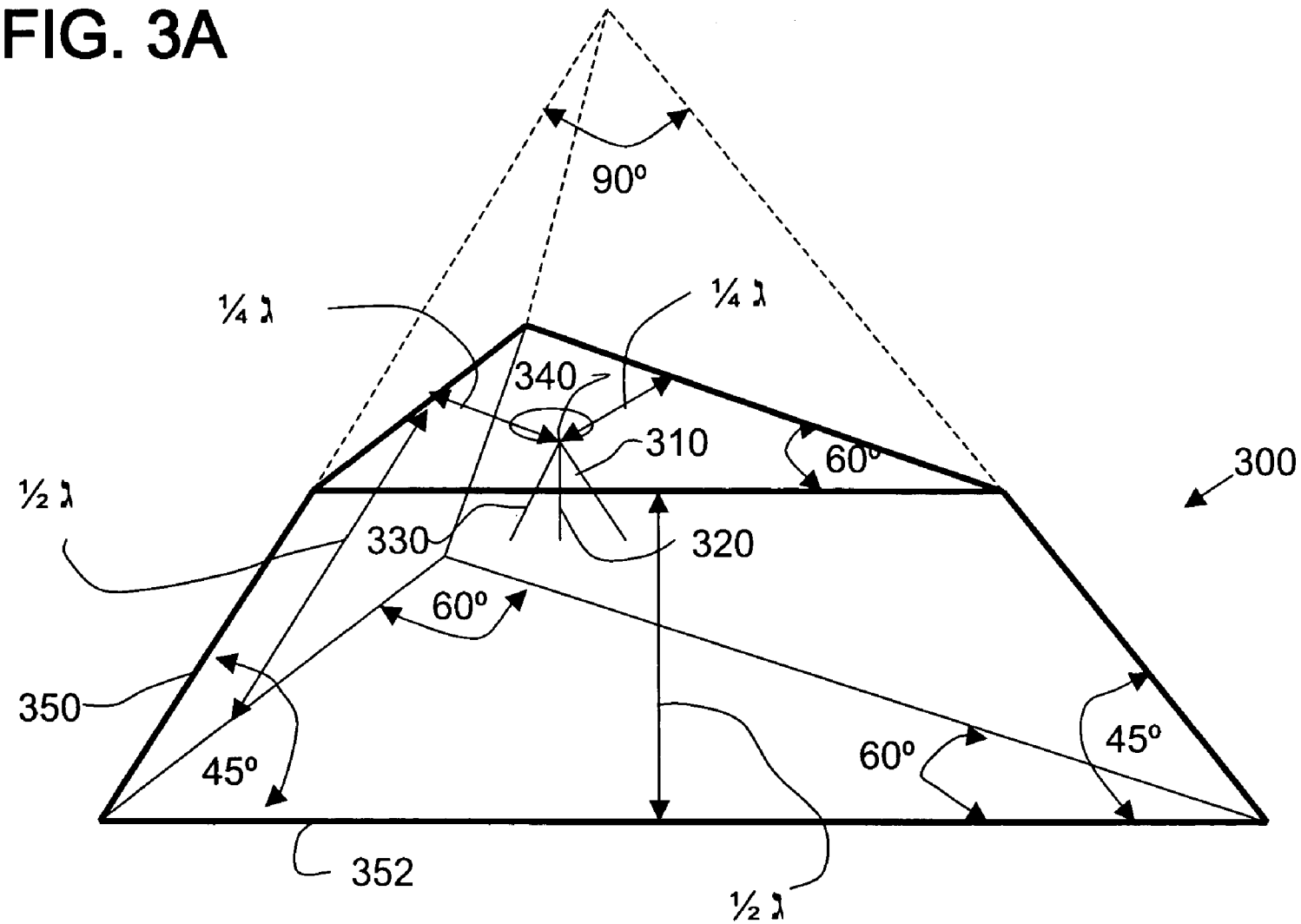
FIG. 3A illustrates a first view of an embodiment of a truncated pyramidal feed element, in accordance with various aspects of the present invention.
Figure 3B:
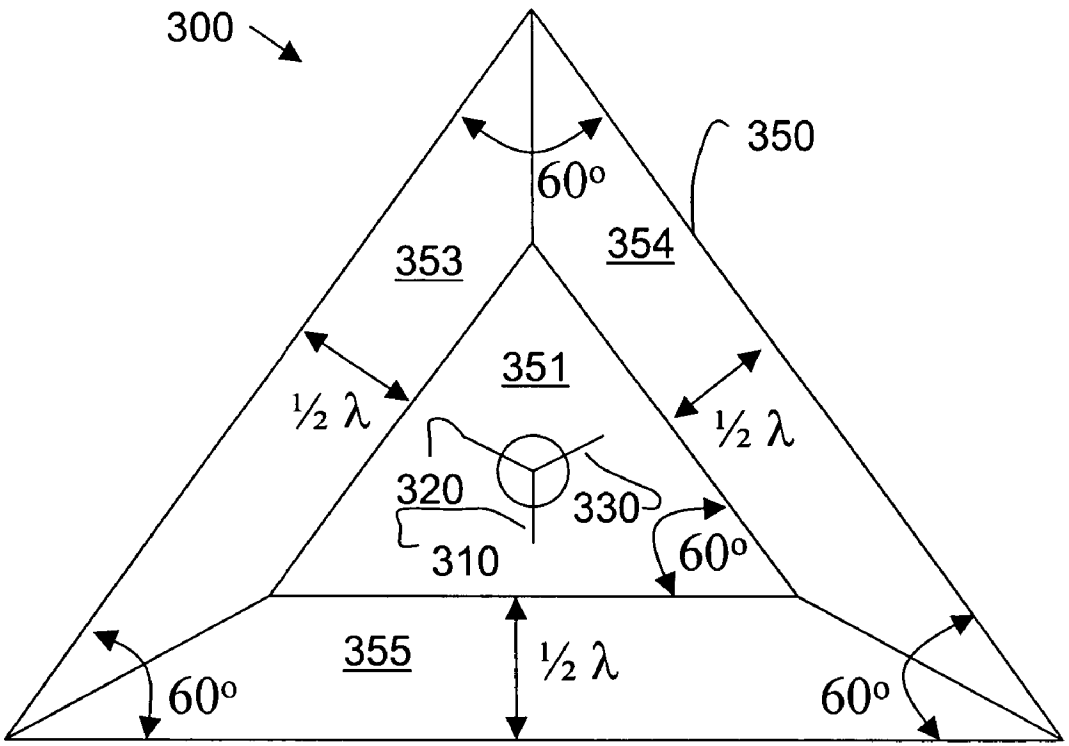
FIG. 3B illustrates a second view of an embodiment of the truncated pyramidal feed element of FIG. 3A, in accordance with various aspects of the present invention.

FIG. 3A illustrates a first view (a perspective view) of an embodiment of a truncated pyramidal feed element 300, in accordance with various aspects of the present invention. FIG. 3B illustrates a second view (looking toward an open base side) of an embodiment of the truncated pyramidal feed element 300 of FIG. 3A, in accordance with various aspects of the present invention. The feed element 300 comprises a truncated pyramidal conductor 350, a first radiative member 310, a second radiative member 320, and a third radiative member 330. The three radiative members 310, 320, and 330 are similar to the three radiative members 110, 120, and 130 of FIG. 1A and FIG. 1B. The truncated pyramidal conductor 350 is formed by truncating a regular pyramidal shape having interior base angles of 60 degrees and exterior angles about the apex of the pyramidal shape of 90 degrees as shown in FIG. 3A. Other interior base angles and exterior angles are possible as well when the slant angles of the radiative members are varied.

The three radiative members 310, 320, and 330 of the feed element 300 are electrically connected together at an apex point 340 such that the three radiative members 310, 320, and 330 are each disposed outwardly away from the apex point 340. The truncated pyramidal conductor 350 includes a closed truncated side 351, an open base side 352, and three closed trapezoidal sides 353, 354, and 355 at least mechanically, if not also electrically, connected to the closed truncated side 351. An open interior space of the truncated pyramidal conductor 350 encompasses the radiative members 310, 320, and 330 such that the apex point 340 is approximately at the center point of the closed truncated side 351 with the radiating members 310, 320, and 330 disposed outwardly away from the closed truncated side 351 and toward the open base side 352.

In accordance with an embodiment of the present invention, the distance between the apex point 340 and the edges of the closed truncated side 351, in a direction perpendicular to the edges, is ¼ wavelength of a tuned radio frequency of operation. Also, the width of each of the three closed trapezoidal sides 353–355, in a direction perpendicular to the parallel top and bottom edges, is ½ wavelength of the tuned radio frequency of operation.

In accordance with an alternative embodiment of the present invention, the distance between the apex point 340 and the edges of the closed truncated side 351, in a direction perpendicular to the edges, is ½ wavelength of a tuned radio frequency of operation. Also, the width of each of the three closed trapezoidal sides 353–355, in a direction perpendicular to the parallel top and bottom edges, is one wavelength of the tuned radio frequency of operation. Other embodiments with different values for the distances and widths are possible as well. For example, by extending the width of the three closed trapezoidal sides 353–355 to 1.5 wavelengths of a tuned radio frequency, the feed 300 by itself becomes an efficient 12 dBi (nearly) equiquadimensionally multi-polarized antenna.

The closed truncated side 351 is electrically connected to a ground reference, in accordance with an embodiment of the present invention, and acts as a triangular ground plane. The feed element 300 may further include an electrical connector similar to the electrical connector 170 shown in FIG. 1A. As a result, the closed truncated side 351 can be electrically connected to an outer conductor 173 (i.e., the ground reference) of the electrical connector 170 and the apex 340 can be electrically connected to the center conductor 171 of the electrical connector 170. In this way, the radiative members 310, 320, and 330 are electrically isolated from the closed truncated side 351 which is acting as a ground plane.

In accordance with various embodiments of the present invention, the three closed trapezoidal sides 353–355 may be electrically connected to or electrically isolated from the closed truncated side 351. Electrical isolation may be accomplished, for example, by including a dielectric liner between the edges of the closed truncated side 351 and the edges of the three closed trapezoidal sides 353–355. The trapezoidal sides 353–355 act as reflectors to reflect electromagnetic waves in a spread pattern (formed additionally by radiative components of the driven elements themselves/acting together) generated by the three radiative members at various angles.

Figure 4:
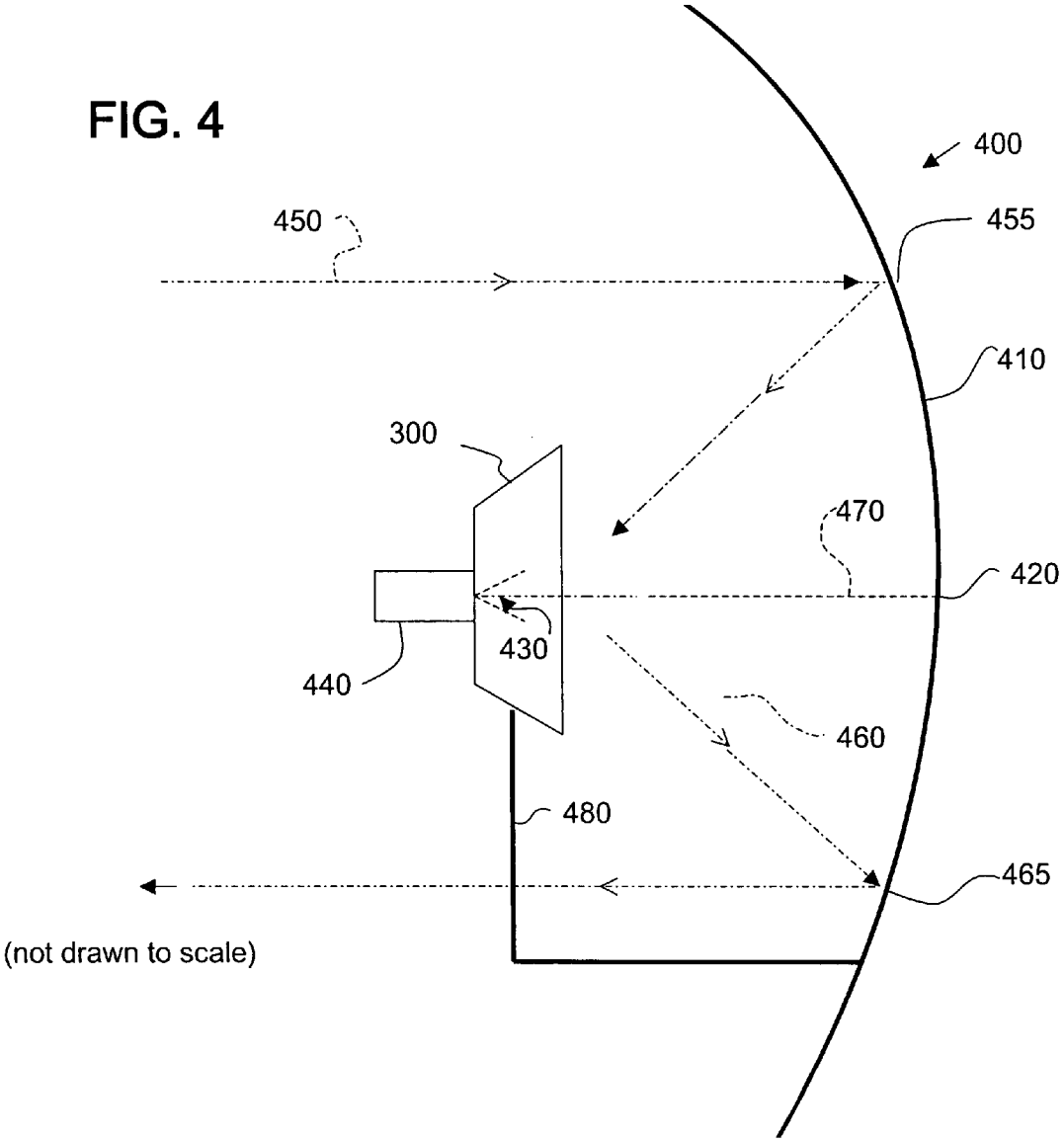
FIG. 4 illustrates a second embodiment of a multi-polarized forward feed and dish configuration using the feed element of FIG. 3A and FIG. 3B, in accordance with various aspects of the present invention.

FIG. 4 illustrates a second embodiment of a multi-polarized forward feed and dish configuration 400 using the feed element of FIG. 3A and FIG. 3B, in accordance with various aspects of the present invention. The configuration comprises a reflector dish 410 having a vertex point 420 and a focal point 430, and a multi-polarized forward feed 300 (i.e., a truncated pyramidal feed element 300) that includes an electrical connector 440 similar to the electrical connector 170 of FIG. 1A.

The reflector dish 410 may comprise, for example, a conductive parabolic reflector or a conductive partial parabolic reflector. The reflector semi-deep dish 410 includes a vertex point 420 and focuses radio frequency energy of a predetermined frequency to a focal point 430 (the focal point is not a physical part of the dish). The radiative members 310, 320, and 330 of the feed element 300 are positioned substantially at the focal point 430.

Referring to FIG. 4, a radio frequency (RF) ray 450 coming from a far off source of RF radiation and impinging on the reflector dish 410 at the point 455 will reflect off of the reflector dish 410 toward the focal point 430. Similarly, an RF ray 460 coming from the feed element 300 and impinging on the reflector dish 410 at the point 465 will reflect off of the reflector dish 410 and out away from the reflector dish 410 along a direction that is parallel to the central axis 470 of the reflector dish 410.

In accordance with an embodiment of the present invention, the configuration 400 further includes a mounting mechanism 480 to allow mounting of the feed element 300 at the focal point 430. The mounting mechanism 480 may be attached to the feed element 300 and the reflector dish 410 or to the feed element 300 and some other structure that allows the feed element 300 to be positioned at the focal point 430 of the reflector dish 410.

In accordance with an embodiment of the present invention, the three radiative members 310, 320, and 330 of the feed element 300 are each aligned with one of the three closed trapezoidal sides 353–355 (see FIG. 3B). As a result, when a radio frequency signal is fed into the electrical connector 440, three primary polarized signals are formed. A first primary polarized signal radiates from radiative member 310 and gets reflected off of trapezoidal side 355 and toward a first sector of the reflector dish 410. A second primary polarized signal radiates from radiative member 320 and gets reflected off of trapezoidal side 353 and toward a second sector of the reflector dish 410. A third primary polarized signal radiates from radiative member 330 and gets reflected off of trapezoidal side 354 and toward a third sector of the reflector dish 410. As a result, three primary slant polarizations are generated by the feed element 300 in 3-dimensional space (i.e., x-y-z coordinate system). In that there are additional driven element interactive components, additional component (slant) source waves are generated, and also, therefore, the driven elements may be axially rotated to a different position, producing similar end results.

In accordance with various embodiments of the present invention, each of the three sectors of the reflector dish 410 may be part of a contiguous parabolic or partial parabolic reflector, or each of the three sectors may be independent parts of a non-contiguous parabolic reflector where each sector is designed for certain performance characteristics at, for example, certain radio frequencies.

Other polarizations are generated as well. For example, in accordance with an embodiment of the present invention, any two radiative members can interact with each other to generate a radio frequency field that is then reflected from a corner (formed by two trapezoidal sides) of the truncated pyramidal conductor 350. As a result, three additional reflected polarizations may be formed corresponding to the three corners of the truncated pyramidal conductor 350 and the pair of radiative members aligned towards each corner.

For example, referring to FIG. 3B, the pair of radiative members 310 and 320 may generate a radio frequency field that gets directed towards and reflected off of the corner formed by the joining of trapezoidal sides 353 and 355. Similarly, the pair of radiative members 310 and 330 may generate a radio frequency field that gets directed towards and reflected off of the corner formed by the joining of trapezoidal sides 354 and 355. Finally, the pair of radiative members 320 and 330 may generate a radio frequency field that gets directed towards and reflected off of the corner formed by the joining of trapezoidal sides 353 and 354. These polarized signals are reflected toward different sectors of the reflector dish 410 and are then reflected outward away from the reflector dish 410 and parallel to the central axis 470 of the reflector dish 410 as previously described.

The configuration of FIG. 4 constitutes an efficient, continuous frequency, multi-band, tri-element, 3-D wave, pyramidal fed, semi-deep dish reflector providing a multi-polarized, multi-plane, multi-path antenna solution. Multiplexor and combiner type devices allow the antenna of FIG. 4, and similar embodiments, to provide continuous communication on multiple bands all at once with one antenna with very limited use of tower space and low wind load. This may provide significant cost savings and be more "politically friendly". Other applications include extreme broad banded spread spectrum/satellite communications.

Continuous frequency, broad banded performance of the antenna of FIG. 4 (and similar embodiments) is driven by a combination of impedance components and elemental interactions of the members of the pyramidal feed as well as by unequal length cuts of the radiative members as described in U.S. application Ser. No. 10/787,031 entitled "Apparatus and Method for a Multi-Polarized Antenna", filed on the same day as the application herein, and which is incorporated herein by reference in its entirety. Off-center feeds and geometric principles can also contribute to broad banded performance.

In accordance with an embodiment of the present invention, the antenna configuration 400 of FIG. 4 is designed such that a primary frequency of operation is 2.4 GHz with an operable bandwidth extending from 1.8 GHz to 5.8 GHz. The radiative members of the driven element of the feed 300 are cut to approximately ¼λ of the primary frequency of operation (2.4 GHz). The reflector dish 410 is an 8-foot semi-deep dish reflector. The gain of the configuration 400 ranges from about 32 dBi to 42 dBi over the bandwidth and the standing wave ratio (SWR) over the bandwidth is less than 2:1 and is generally about 1.5:1. The configuration 400 provides multi-polarization capability and improved signal-to-noise ratio with obstructed environment penetration.

Figure 5:
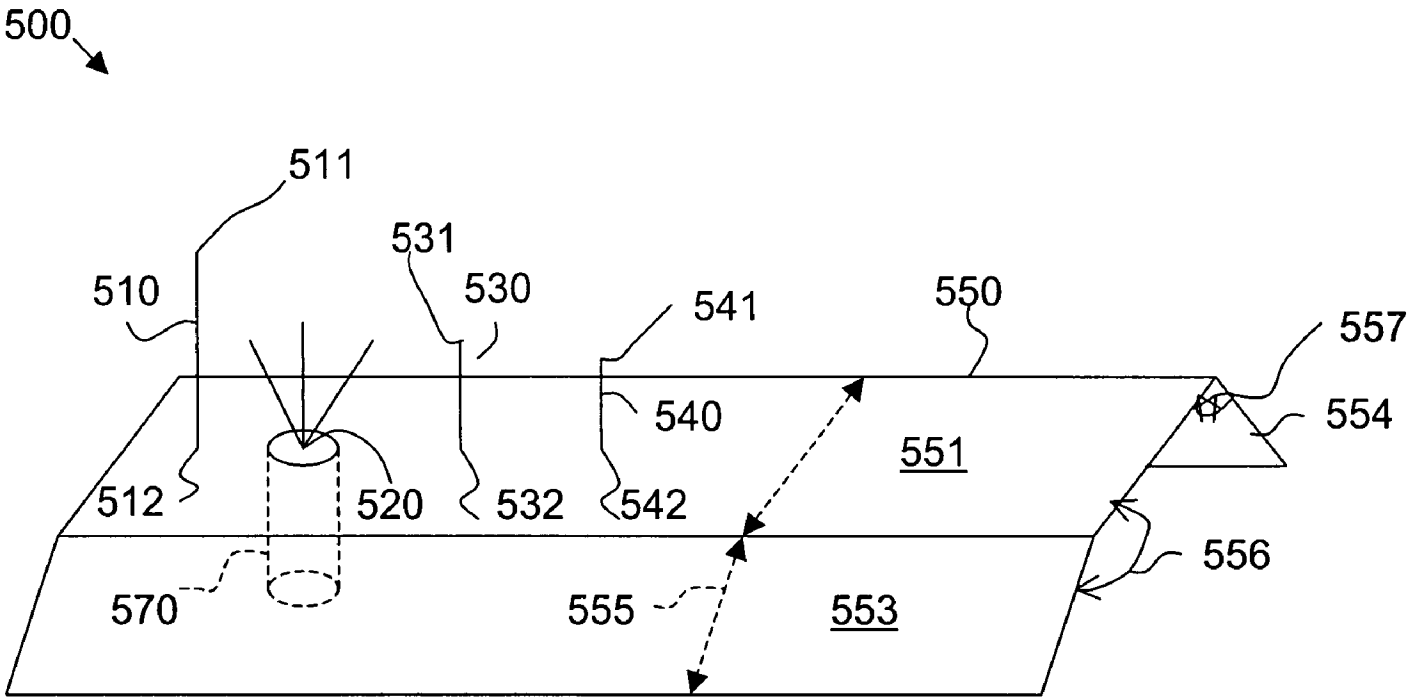
FIG. 5 illustrates an exemplary embodiment of a multi-polarized ground plane beam antenna using the feed element of FIG. 1A as a driven element, in accordance with various aspects of the present invention.

FIG. 5 illustrates an exemplary embodiment of a multi-polarized ground plane beam antenna 500 using the feed element 100 of FIG. 1A as a driven element, in accordance with various aspects of the present invention. The antenna 500 comprises a parasitic reflector element 510, a multi-polarized driven element 520 (i.e., similar to that of feed element 100 in FIG. 1A), a first parasitic director element 530, a second parasitic director element 540, and an electrically conductive ground plane 550. The parasitic reflector element 510 includes a first end 511 and a second end 512. The first parasitic director element 530 includes a first end 531 and a second end 532. The second parasitic director element 540 includes a first end 541 and a second end 542.

The multi-polarized driven element 520 is generated as in FIG. 1A. The reflector element 510, driven element 520, first director element 530, and second director element 540 are positioned co-linearly with respect to each other such that the driven element 520 is between the reflector element 510 and the first director element 530. The electrically conductive ground plane 550 is generated comprising a substantially rectangular, first conductive sheet 551 having a width of about ¼ wavelength of a tuned radio frequency (e.g., the tuned radio frequency of the driven element) and is positioned substantially parallel to the imaginary plane 150 of FIG. 1A. The first conductive sheet 151 may comprise a metal sheet such as, for example, copper. The second ends 512, 532, and 542 of the reflector and director elements 510, 530, and 540 are electrically connected (e.g., welded and/or soldered) to the conductive sheet 551 of the ground plane 550. The connector 570 of the driven element 520 may pass through a hole in the conductive sheet 551.

The ground plane 550 further comprises substantially rectangular second 553 and third 554 conductive sheets, each having a width 555 of about ¼ wavelength of the tuned radio frequency. Each conductive sheet 553 and 554 is substantially the same length as the first conductive sheet 551. The second conductive sheet 553 has a first lengthwise edge that is mechanically and electrically connected to a first lengthwise edge of the first conductive sheet 551, as shown in FIG. 5, and forms an angle 556 with respect to the first conductive sheet 551. The third conductive sheet 554 has a first lengthwise edge that is mechanically and electrically connected to a second lengthwise edge of the first conductive sheet 551, and forms an angle 557 with respect to the first conductive sheet 551. The second and third angled conductive sheets 553 and 554 help to shape the resultant beam pattern of the antenna 500, support multi-polarization, and minimize side lobes. One-half of the width of sheet 551 plus the full width of sheet 553 is at least ¼ wavelength, in accordance with an embodiment of the present invention. Similarly, one-half of the width of sheet 551 plus the full width of sheet 554 is at least ¼ wavelength, in accordance with an embodiment of the present invention.

In accordance with an embodiment of the present invention, the multi-polarized driven element 520 includes an electrical connector (e.g., a coaxial connector) 570 (similar to connector 170 in FIG. 1A) which comprises (referring to FIG. 1A) a center conductor 171, an insulating dielectric region 172, and an outer conductor 173. The electrical connector 570 serves to mechanically connect the three radiative members of the driven element 520 to the ground plane 550 and to allow electrical connection of the radiative members and the ground plane 550 to a transmission line for interfacing to a radio frequency (RF) transmitter and/or receiver.

For example, referring to FIG. 1A and FIG. 5, the center conductor 171 electrically connects to the apex 140 of the radiative members 110, 120, and 130 and the outer conductor 173 electrically connects to the ground plane 550. The insulating dielectric region 172 electrically isolates the center conductor 140 (and therefore the radiative members 110, 120, and 130) from the outer conductor 173 (and therefore from the ground plane 550). The insulating dielectric region 172 may also serve to mechanically connect the radiative members 110, 120, and 130 to the ground plane 550, in accordance with an embodiment of the present invention.

In accordance with other embodiments of the present invention, the number of radiative members of the driven element 520 may be only two or may be greater than three. For example, four radiative members circumferentially spaced at 90 degrees may be used. In fact, a large number of radiative members may be effectively replaced with a continuous surface of a cone, a pyramid, or some other continuous shape that is spatially diverse on one side (i.e., has significant spatial extent) and comes substantially to a point (e.g., an apex) on the other side. For example, in accordance with an embodiment of the present invention, a linear radiative member connected at one end to a radiative loop having a certain spatial extend may be used.

The multi-polarized ground plane beam antenna 500 generates a far-field beam of radio frequency energy in the general direction from the reflector element 510 towards the director element 540 when the driven element 520 is energized by a transmitter with a radio frequency signal. Also, the multi-polarized ground plane beam antenna 500 receives radio frequency signals with a directivity being generally along a direction from the director element 540 to the reflector element 510 when the driven element 520 is connected to a receiver.

Figure 6A:
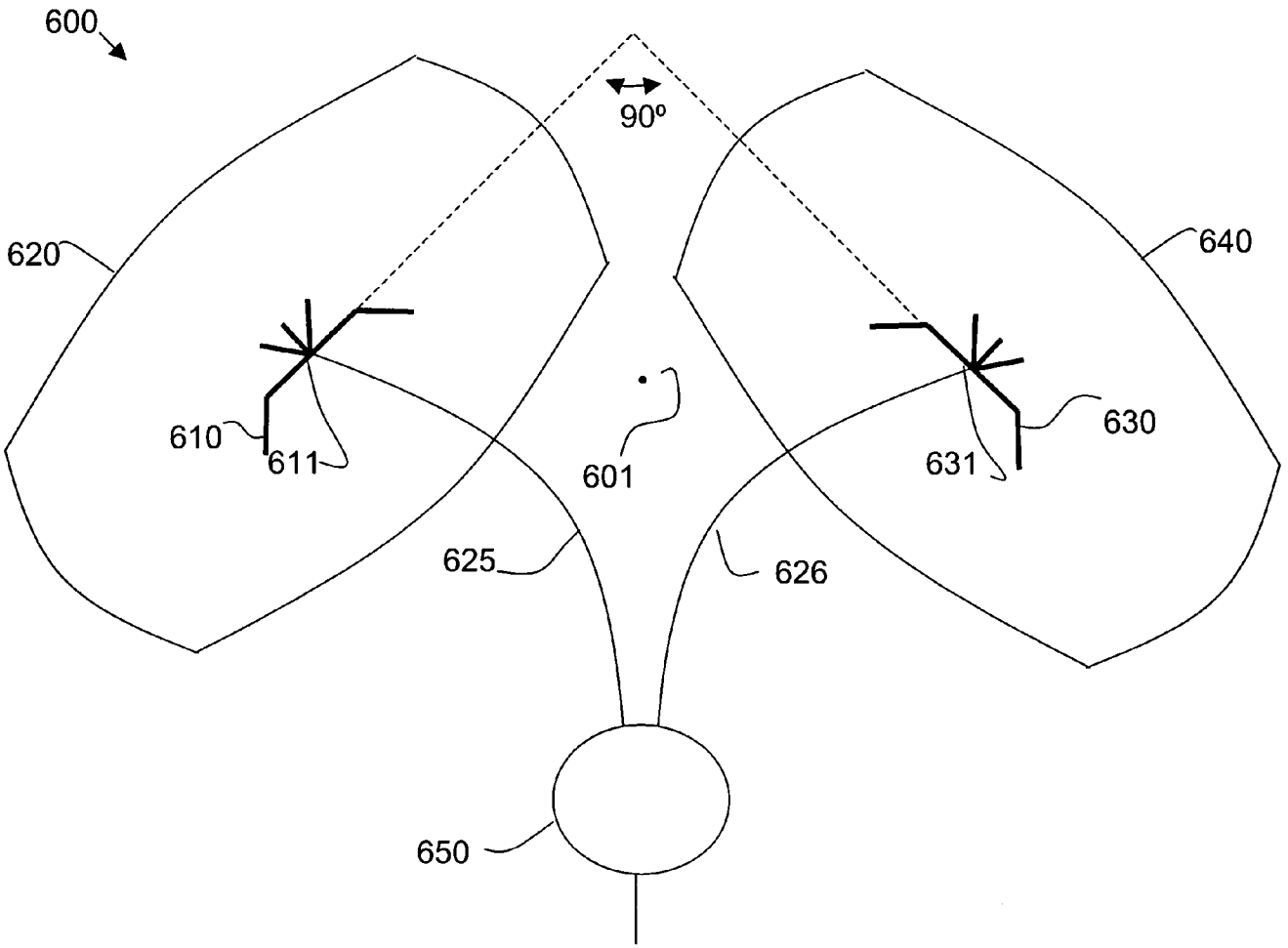
FIG. 6A illustrates a first view (e.g., a side view) of a third embodiment of a multi-polarized forward feed and dish configuration using two of the ground plane beam antennas of FIG. 5, in accordance with various aspects of the present invention.
Figure 6B:
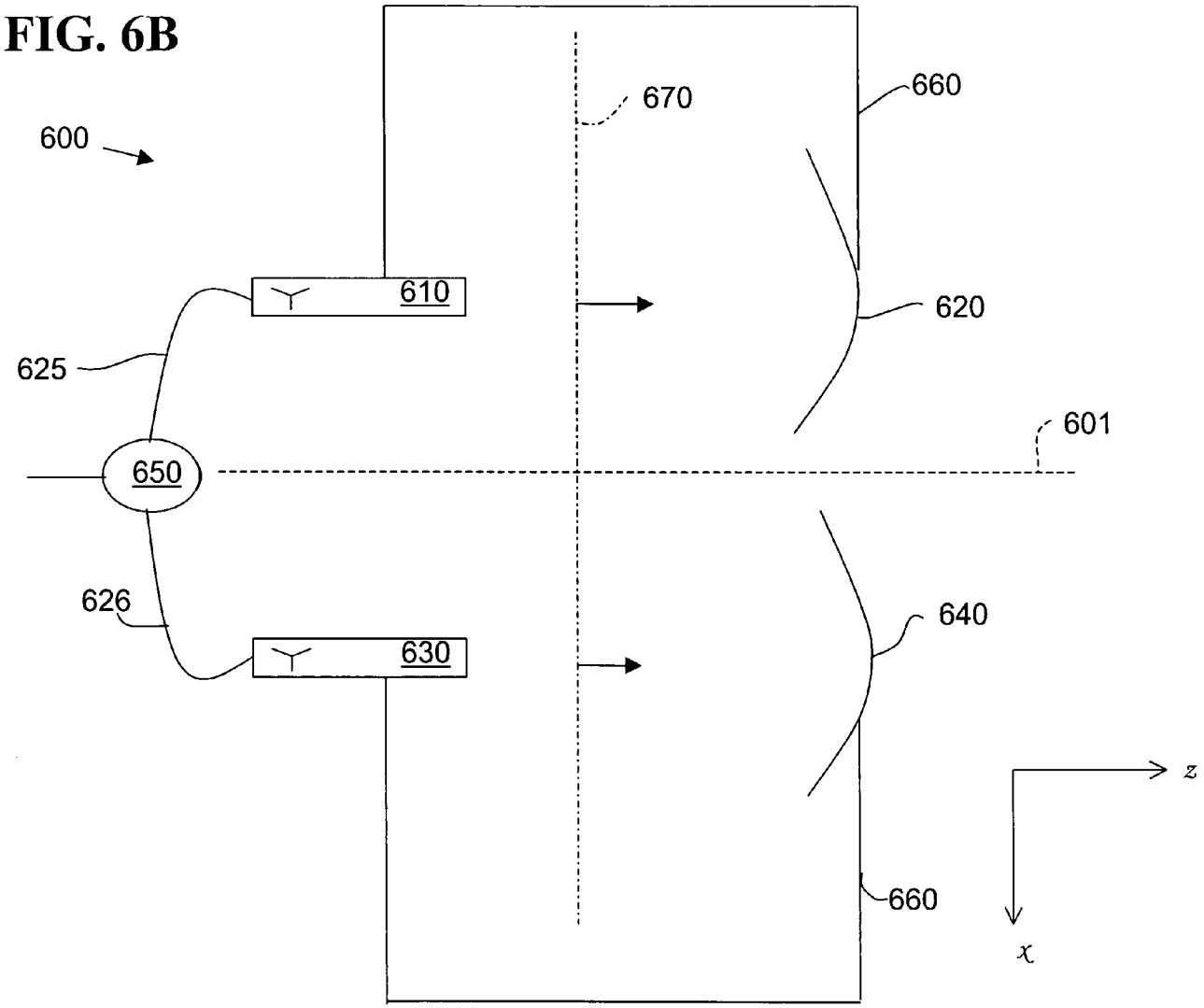
FIG. 6B illustrates a second view (e.g., a top view) of a third embodiment of a multi-polarized forward feed and dish configuration using two of the ground plane beam antennas of FIG. 5, in accordance with various aspects of the present invention.

FIG. 6A illustrates a first view (e.g., a side view in an x-y plane) of a third embodiment of a multi-polarized forward feed and dish configuration 600 using two of the ground plane beam antennas 500 of FIG. 5, in accordance with various aspects of the present invention. FIG. 6B illustrates a second view (e.g., a top view in an x-z plane) of a third embodiment of a multi-polarized forward feed and dish configuration 600 using two of the ground plane beam antennas 500 of FIG. 5, in accordance with various aspects of the present invention.

In accordance with an alternative embodiment of the present invention, one ground plane beam feed with one paraboloid reflector may be used. However, two of each as described herein enhances multi-polarization (~equiquadimensionally multi-polarized) and enhances spatial diversity.

The configuration 600 comprises a first multi-polarized ground plane beam antenna 610 (acting as a feed element) and a first reflector dish 620, a second multi-polarized ground plane beam antenna 630 (acting as a feed element) and a second reflector dish 640. The configuration 600 also includes a two-port power divider 650. The reflector dishes 620 and 640 are each designed such that electromagnetic energy coming toward the dish from the far field is reflected off of the dish and focused to a focal point in front of the dish. The dishes 620 and 640 may be parabolic dishes or partially parabolic dishes in accordance with various embodiments of the present invention.

The beam antenna 610 is positioned substantially at the focal point of the reflector dish 620 such that electromagnetic energy radiated by the beam antenna 610 is directed toward the reflector dish 620, and electromagnetic energy reflected off of the dish 620 from an incoming far field wave 670 is directed toward the beam antenna 610. Similarly, the beam antenna 630 is positioned substantially at the focal point of the reflector dish 640 such that electromagnetic energy radiated by the beam antenna 630 is directed toward the reflector dish 640, and electromagnetic energy reflected off of the dish 630 from an incoming far field wave 670 is directed toward the beam antenna 640.

In accordance with an embodiment of the present invention, each beam antenna 610 and 630 may be held in place substantially at the focal points of the respective dishes 620 and 640 by a mounting mechanism 660. The mounting mechanism 660 may connect the beam antennas to the dishes or to some other structure to keep the beam antennas at the focal points of the dishes. The mounting mechanism 660 may also be used to keep the first beam antenna dish pair 610 and 620 in a constant position relative to the second beam antenna and dish pair 630 and 640, in accordance with various embodiments of the present invention.

In accordance with an embodiment of the present invention, the first beam antenna and dish pair 610 and 620 is positioned at a 90 degree angle (~EquiQuaDimensional (a term coined herein) results) with respect to the second beam antenna and dish pair 630 and 640 in the x-y plane as shown in FIG. 6A. Also, the distance between the apex points 611 and 631 of the ground plane beam antennas 610 and 630 is fixed based on, at least in part, a predefined radio frequency of operation.

The two port power divider 650 is used to feed a radio frequency signal in phase to both the first and second multi-polarized ground plane beam antennas 610 and 630 on transmit, and to combine signals received by the two ground plane beam antennas 610 and 630 in phase upon receive. The electrical connection between the two-port power divider 650 and the two-ground plane beam antennas 610 and 630 may be accomplished via, for example, two coaxial cable connections 625 and 626 of equal length. In accordance with an embodiment of the present invention, the two-port power divider 650 may include a simple T-connector with proper impedance matching coaxial transformers.

Upon transmission, the signals from the beam antennas 610 and 630 reflect off of their respective dishes 620 and 640 and add in phase in the far field to create a beam of electromagnetic radiation in a direction substantially parallel to a central axis 601 of the multi-polarized configuration 600.

Because of the 90-degree orientation of the two pairs of beam antennas and dishes, the multi-polarized configuration 600 may be rotated to any orientation about the central axis 601 of the configuration 600 without negatively affecting the resultant main beam of the antenna pattern created by the multi-polarized configuration or the other characteristics of spatial diversity and capture of the preferred polarization path. As a result, the performance of the multi-polarized configuration 600 is highly independent of spatial orientation.

Similarly, single polarized beam antennas and dish configurations can be used in such a manner producing equivalency of polarizations in a single plane (e.g., x-y plane). However, by using the multi-polarized beam antennas in the configuration of FIG. 6A and FIG. 6B, further polarization equivalency occurs in the added z-axis (EquiQuaDimenstional, a term coined herein), and even further spatial diversity characteristics are seen.

Figure 6C:
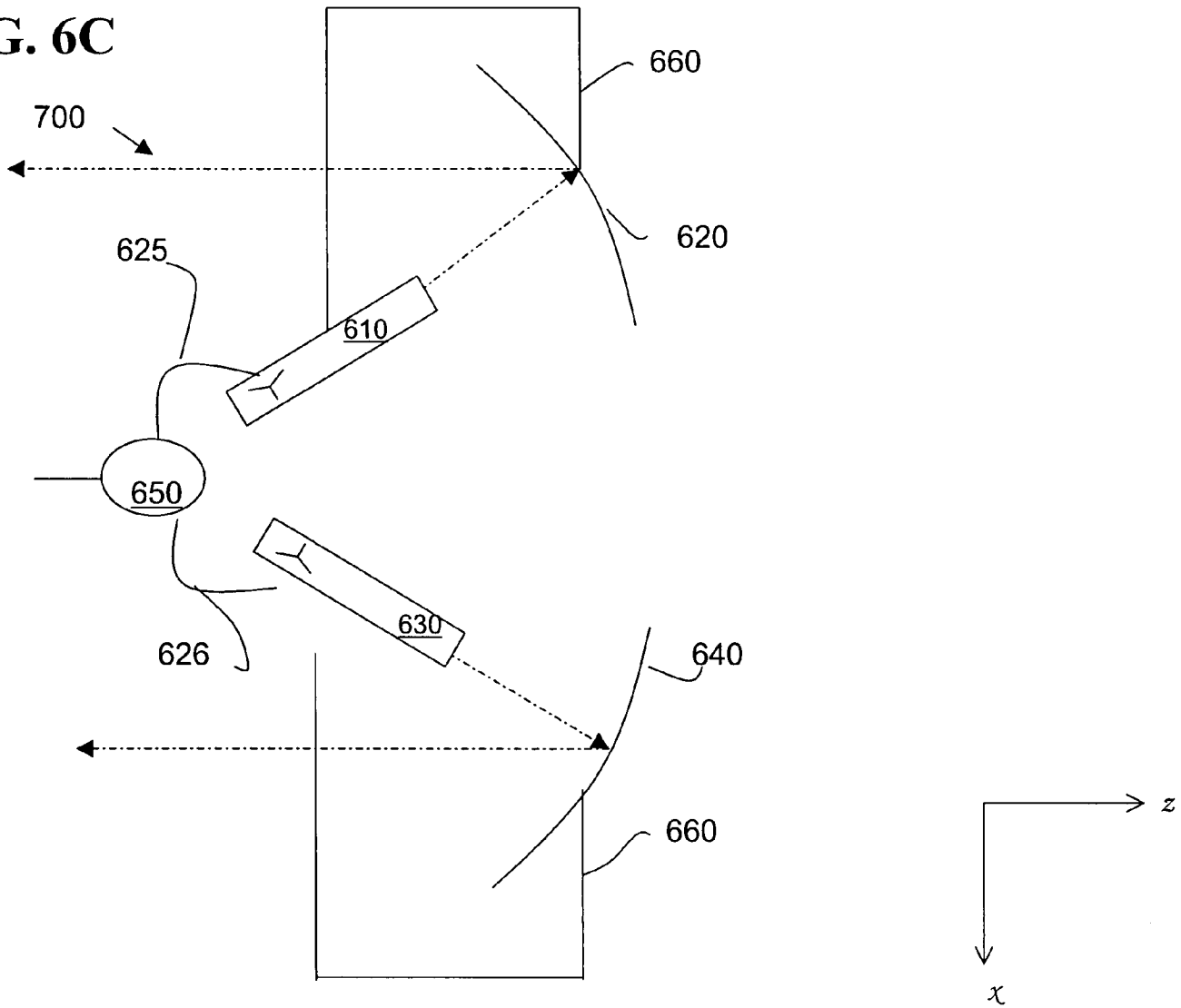
FIG. 6C illustrates a modified configuration of the third embodiment of a multi-polarized forward feed and dish configuration shown in FIG. 6B, in accordance with various aspects of the present invention.

FIG. 6C illustrates a modified configuration 700 of the third embodiment of a multi-polarized forward feed and dish configuration 600 shown in FIG. 6B, in accordance with various aspects of the present invention. The modified configuration 700 further angles the ground plane beam antennas 610 and 630 and corresponding dish reflectors 620 and 640 in a second plane (x-z plane). Such a configuration 700 may provide additional spatial diversity.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A multi-polarized forward feed and dish configuration for transmitting and/or receiving radio frequency (RF) signals, said configuration comprising:

a conductive reflector dish having a focal point and a vertex point; and a multi-polarized forward feed element and a mounting mechanism for mounting of said feed element at a position substantially at said focal point, and wherein said feed element comprises at least two radiative members each having a first end and a second end, and wherein said second ends of said radiative members are electrically connected at an apex point and are each disposed outwardly away from said apex point toward said vertex point at an acute angle relative to an imaginary plane intersecting said apex point.

2. The feed element of claim 1 further comprising a conductive ground reference located at and/or to a side of said imaginary plane that is away from said apex point, and being electrically isolated from said radiative members.

3. The feed element of claim 2 wherein said conductive ground reference comprises as least one of a ground braid of a coaxial connection, a cylindrical sleeve, a conical sleeve, and a ground plane.

4. The feed element of claim 2 further comprising a dielectric material serving to mechanically connect, at least in part, said radiative members to said ground reference while electrically insulating said radiative members from said ground reference.

5. The feed element of claim 4 further comprising an electrical conductor electrically connected to said radiative members at said apex point and extending away from said apex point toward a ground reference side of said feed element through said dielectric material to allow connection to a transmission line for interfacing said radiative members to a radio frequency transmitter and/or receiver.

6. The feed element of claim 2 further comprising an electrical connector to allow connection of said radiative members and said ground reference to a transmission line.

7. The feed element of claim 3 wherein said ground plane comprises a circular conductive ground plane having a radius of at least ¼ wavelength of a tuned radio frequency.

8. The feed element of claim 1 wherein each of said radiative members are substantially linear and have a physical length determined by a pre-defined radio frequency.

9. The feed element of claim 1 wherein said acute angle between each of said radiative members and said imaginary plane is between 1 degree and 89 degrees.

10. The feed element of claim 1 wherein said radiative members are equally spaced in angle circumferentially around 360 degrees.

11. The feed element of claim 2 further comprising a truncated pyramidal conductor that includes a closed truncated side, an open base side, and three closed trapezoidal sides, and wherein an open interior space of said truncated pyramidal conductor encompasses said radiative members such that said apex point is approximately at a center point of said closed truncated side and said radiative members are disposed outwardly away from said closed truncated side toward said open base side.

12. The feed element of claim 11 wherein said truncated pyramidal conductor is electrically connected to said ground reference and is electrically isolated from said radiative members.

13. The feed element of claim 11 wherein said closed truncated side is electrically connected to said ground reference and is electrically isolated from said radiative elements and from said closed trapezoidal sides.

14. The configuration of claim 1 wherein said conductive reflector dish comprises one of a parabolic dish, a parabolic dish with at least three distinct sectors, a partial parabolic dish, and a partial parabolic dish with at least three distinct sectors.

15. A multi-polarized forward feed for transmitting and/or receiving radio frequency (RF) signals to/from a reflector dish, said forward feed comprising:

at least two radiative members each having a first end and a second end, and wherein said second ends of said radiative members are electrically connected at an apex point and are each disposed outwardly away from said apex point at an acute angle relative to an imaginary plane intersecting said apex point; and a truncated pyramidal conductor that includes a closed truncated side, an open base side, and three closed trapezoidal sides, and wherein an open interior space of said truncated pyramidal conductor encompasses said radiative members such that said apex point is approximately at a center point of said closed truncated side and said radiative members are disposed outwardly away from said closed truncated side toward said open base side.

16. The forward feed of claim 15 wherein said truncated pyramidal conductor serves as a ground reference and is electrically isolated from said radiative members.

17. The forward feed of claim 15 wherein said closed truncated side serves as a ground reference and is electrically isolated from said radiative members and from said closed trapezoidal sides.

18. The forward feed of claim 16 further comprising an electrical connector to allow connection of said radiative members and said truncated pyramidal conductor to a transmission line.

19. The forward feed of claim 17 further comprising an electrical connector to allow connection of said radiative members and said closed truncated side to a transmission line.

20. The forward feed of claim 15 wherein each of said radiative members are substantially linear and have a physical length determined by a pre-defined radio frequency.

21. The forward feed of claim 15 wherein said acute angle between each of said radiative members and said imaginary plane is between 1 degree and 89 degrees.

22. The forward feed of claim 15 wherein said radiative members are equally spaced in angle circumferentially around 360 degrees.

* * * * *